US009751123B2

(12) United States Patent
Zhao et al.

(10) Patent No.: US 9,751,123 B2
(45) Date of Patent: Sep. 5, 2017

(54) AUTOMATIC INTEGRAL FORMING METHOD FOR DOUBLE-CURVATURE PLATE OF SHIP

(71) Applicant: Huazhong University of Science and Technology, Wuhan (CN)

(72) Inventors: Yao Zhao, Wuhan (CN); Hua Yuan, Wuhan (CN); Guoyuan Tang, Wuhan (CN); Hongbao Dong, Wuhan (CN); Changcheng Hu, Wuhan (CN); Jun Yan, Wuhan (CN)

(73) Assignee: Huazhong University of Science and Technology, Wuhan (CN)

( * ) Notice: Subject to any disclaimer, the term of this patent is extended or adjusted under 35 U.S.C. 154(b) by 346 days.

(21) Appl. No.: 14/584,943

(22) Filed: Dec. 29, 2014

(65) Prior Publication Data

US 2016/0059291 A1 Mar. 3, 2016

(30) Foreign Application Priority Data

Aug. 26, 2014 (CN) ..... 2014 1 0424903

(51) Int. Cl.
*B21D 11/20* (2006.01)
*B63B 3/60* (2006.01)

(52) U.S. Cl.
CPC ..... *B21D 11/20* (2013.01); *B63B 3/60* (2013.01)

(58) Field of Classification Search
CPC ..... B21D 5/008; B21D 5/14; B21D 11/20; B21D 11/203; B21D 11/206; B21D 39/023; B63B 3/56; B63B 3/60
USPC ..... 72/342.1, 342.2, 342.5, 342.6
See application file for complete search history.

(56) References Cited

U.S. PATENT DOCUMENTS 2,242,204 A * 5/1941 Kennedy ..... B21D 11/20 72/202
4,120,187 A * 10/1978 Mullen ..... C21D 9/46 148/639
6,477,879 B1 * 11/2002 Sawa ..... B21D 39/021 29/243.58

FOREIGN PATENT DOCUMENTS

KR 20100066211 A * 6/2010 ..... B21D 11/20

OTHER PUBLICATIONS

Machine translation of KR 20100066211A, Park et al. pp. 1-17, translated on Feb. 1, 2017.*

* cited by examiner

*Primary Examiner* — Teresa M Ekiert
(74) *Attorney, Agent, or Firm* — Hamre, Schumann, Mueller & Larson, P.C.

(57) ABSTRACT

The present invention provides an automatic integral forming method for a double-curvature plate of a ship, comprising: a) constructing a loading system for integral forming; b) establishing relationship between basic forming data and processing data of the plate according to a requirement for a forming process; c) making prototyping software according to the relationship between the basic data and the processing data, installing the prototyping software on the control device, starting the prototyping software to load the plate so that the plate is plastically deformed in double curvature. The present invention features easy operation, high intelligence, high precision and wide application range, and thus is especially applicable for automatic forming of large-curvature plates such as saddle-shaped plates, sail-shaped plates, twisted plates, plates combining shapes thereof and so on.

9 Claims, 2 Drawing Sheets

AUTOMATIC INTEGRAL FORMING METHOD FOR DOUBLE-CURVATURE PLATE OF SHIP

CROSS-REFERENCE TO RELATED APPLICATION

Figure 1:
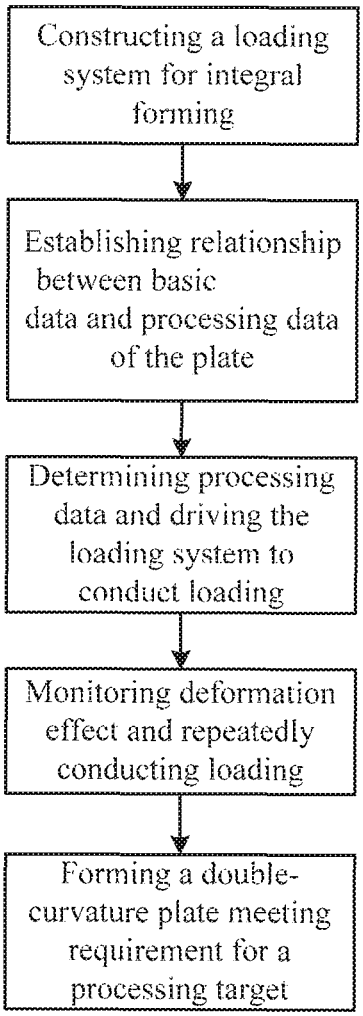

The present application claims priority to Chinese Application No. 2014104249032, filed on Aug. 26, 2014, which is hereby incorporated by reference in its entirety.

FIELD OF THE INVENTION

The invention relates to ship building technology area, and more particularly to an automatic integral forming method for a double-curvature plate of a ship.

BACKGROUND OF THE INVENTION

Due to the facts that production of ships adopts a make-to-production method for every single product, and double-curvature plates thereof have certain structural characteristics, a forming processing method for the double-curvature plates are different that for film plates of vehicles, which employs massive production of die stamping. At present, conventional forming methods for curvature plates of ships mainly comprises a line heating method, a cylindrical rolling method, a multi-point bending method, and so on.

The line heating method is to conduct partial and linear heating on plates via line heat source such as flame or high-frequency induction heaters based on a principle of thermal expansion and contraction, so that residual plastic deformation of a work piece appears and enables the plates to be bent and formed. During the process, water may be sprayed on heating lines for reducing temperature thereon after line heating according to requirement of ships' structure for properties of materials, whereby improving forming efficiency. However, due to relationship between temperatures and the materials properties, an actual processing temperature needs to be controlled within a certain range, which may influence forming efficiency in a condition of large curvature and thick plates. In addition, for forming of a plate with different in-plane strain and out-of plane strain on different surface at different positions thereof (such as a twisted plate), it is difficult for the line heating method to meet requirement for the forming processing.

It is obvious that the cylindrical rolling method cannot enable processing of a double-curvature shape, but a single-curvature shape. As for the multi-point bending method like a multi-point cold pressing method, since it completely relies on force applied to a plate that is to be formed, and the force and range of the force are extremely large, a problem of resisting resilience caused thereby becomes very protuberant, and total volume of corresponding equipments and construction cost thereof may be increased. Moreover, no matter cold processing or hot processing is employed in the above-mentioned methods, problems therewith, such as uncertain quality, low processing efficiency and so on, still exist since it is mainly depend on experience-based manual operation or manual control.

SUMMARY OF THE INVENTION

In view of the above-mentioned problems with the prior art and requirement for improvement, it is an objective of the invention to provide an automatic integral forming method for a double-curvature plate of a ship that is capable of improving processing efficiency, depressing unwanted impact of processing on materials of the plate, reducing equipment cost and work intensity of operators, and significantly increasing forming precision of the double-curvature plate by combining features of different integral forming methods comprising heat loading, force loading, water cooling and so on, and applying a loading system for integral forming along with a computer simulation technology to forming processing.

To achieve the above objectives, in accordance with one embodiment of the invention, there provided an automatic integral forming method for a double-curvature plate of a ship, comprising steps of:

a) constructing a loading system for integral forming, the loading system for integral forming comprising a frame and a control device disposed on the frame, a heat loading component, a pressure loading device and a water spraying component being sequentially disposed on the frame, the heat loading component heating a plate to be formed by line heating, and the pressure loading device comprising an upper pressure loading device and a lower pressure loading device collaborating with each other whereby applying pressure on the plate;

b) establishing relationship between basic forming data and processing data of the plate according to a requirement for a forming process, the basic data comprising material properties, a thickness, a target shape, and a target curvature of the plate, and the processing data comprising shapes of an upper roller and a lower roller, force applied thereby or displacement thereof, enabling/disabling of the heat loading component and a position thereof, input voltage and current for heat control, enabling/disabling of the water spraying component, water flow and a position thereof, and starting and ending positions, travel trajectories and travel speeds of the heat loading component, the pressure loading device, and the water spraying component that maintain loading status altogether or independently;

c) making prototyping software according to the relationship between the basic data and the processing data, installing the prototyping software on the control device, starting the prototyping software for the plate, inputting basic data in the prototyping software whereby obtaining processing data according to the basic data, driving the heat loading component, the pressure loading device, and the water spraying component to load the plate so that the plate is plastically deformed in double curvatures;

d) monitoring deformation effect of the plate that is plastically deformed, detecting and feeding back if there is difference between a shape and curvature thereof and the target shape and curvature, restarting the prototyping software whereby enabling the loading system to load the plate until a double-curvature plate meeting requirement for a processing target is formed if there is difference therebetween.

Advantageously, the upper pressure loading device comprises a first motor disposed on the frame, an upper rotating shaft is vertically disposed on the first motor and capable of rotating under the drive thereof, the upper roller is disposed on the upper rotating shaft, the lower pressure loading device comprises a second motor disposed on the frame, a lower rotating shaft is vertically disposed on the second motor and capable of rotating under the drive thereof, a lower frame and a lower receiving base are disposed on the lower rotating shaft, the lower receiving base is disposed above the lower frame, the water spraying component is disposed on the lower frame, a third motor is disposed on the lower receiving base, and the lower roller is disposed on the third motor and capable of rotating under the drive thereof.

Advantageously, in step a), the upper roller and the lower roller are of various shapes and sizes, and removably disposed on the upper rotating shaft and the lower rotating shaft, respectively.

Advantageously, establishing the relationship between the basic forming data and the processing data of the plate of step b) comprises firstly inputting the material properties, the thickness, and all processing data from the basic data, and then performing thermal elastic plastic simulation or spatial curved surface geometry analysis, whereby obtaining the target shape and the target curvature in the basic data.

Advantageously, after obtaining the relationship between the basic data and the processing data of the plate, an expert database for integral forming is established for the basic data and the processing data, and operates to quickly obtain processing data corresponding to basic data that are input, or to obtain following processing data as there is difference between forming effect and the processing target of the plate.

Advantageously, after establishing the expert database for integral forming, processing data in the expert database are optimized via an artificial neural network algorithm, comprising: simultaneously selecting the basic data of the plate as input samples, and the processing data as output samples, training a neutral network using the input samples and the output samples whereby optimizing the number of neurons and that of hidden layers thereof, and finally storing an optimized network in the expert database for the purpose of reservation.

Advantageously, in step c), during a process of driving the loading system to load the plate, the heat loading component, the pressure loading device, and the water spraying component conduct loading in multiple ways.

Advantageously, to conduct loading in multiple ways means that the heat loading component, the pressure loading device and the water spraying component, or only the pressure loading device, or the heat loading component and the pressure loading device, or the heat loading component and the water spraying component are loaded on the plate.

Advantageously, in step d), monitoring of forming effect of the plate, and detection and feedback of difference between the forming effect and the processing target are conducted via a laser monitoring technique.

To summarize, the present invention comprises the following advantages over the prior art:

1. by combining line heating of the heat loading component, force loading of the pressure loading device, and cold loading of the water spraying component altogether and then integrally applying them to a forming process of the double-curvature plate of a ship, especially by designing a specific loading process thereof, it is possible to overcome a defect with a conventional line heating method that it cannot process a large-curvature plate, to improve processing efficiency, to effectively prevent unwanted impact of high temperature or rapid cooling on the materials of the plate, and to reduce operation complexity of the process by combination of different loading methods based on actual requirement;

2. by using partial loading and incremental forming during the integral loading process, it is possible to resist deformation resilience, and to reduce driving force that the loading system for integral forming requires, and requirement for the loading system for integral forming and an installation foundation thereof;

3. compared with the prior art that conducts the forming process mainly by manual operation and personal experience, the invention is capable of significantly increasing automation and forming efficiency during construction of a ship and shortening a manufacturing period by establishing the expert database for the basic data and the processing data of the plate that is to be formed; in addition, the invention obtains the optimum loading scheme by employing the artificial neural network algorithm, which can effectively reduce a length of a loading path, and thus further improving the forming precision and efficiency;

4. the integral forming method of the invention is easy for operation and controlling, and features high intelligence and precision, and wide application range, and therefore is especially applicable for automatic forming of large-curvature plates such as saddle-shaped plates, sail-shaped plates, twisted plates, plates combining shapes thereof and so on.

BRIEF DESCRIPTION OF THE ACCOMPANYING DRAWINGS

Figure 2:
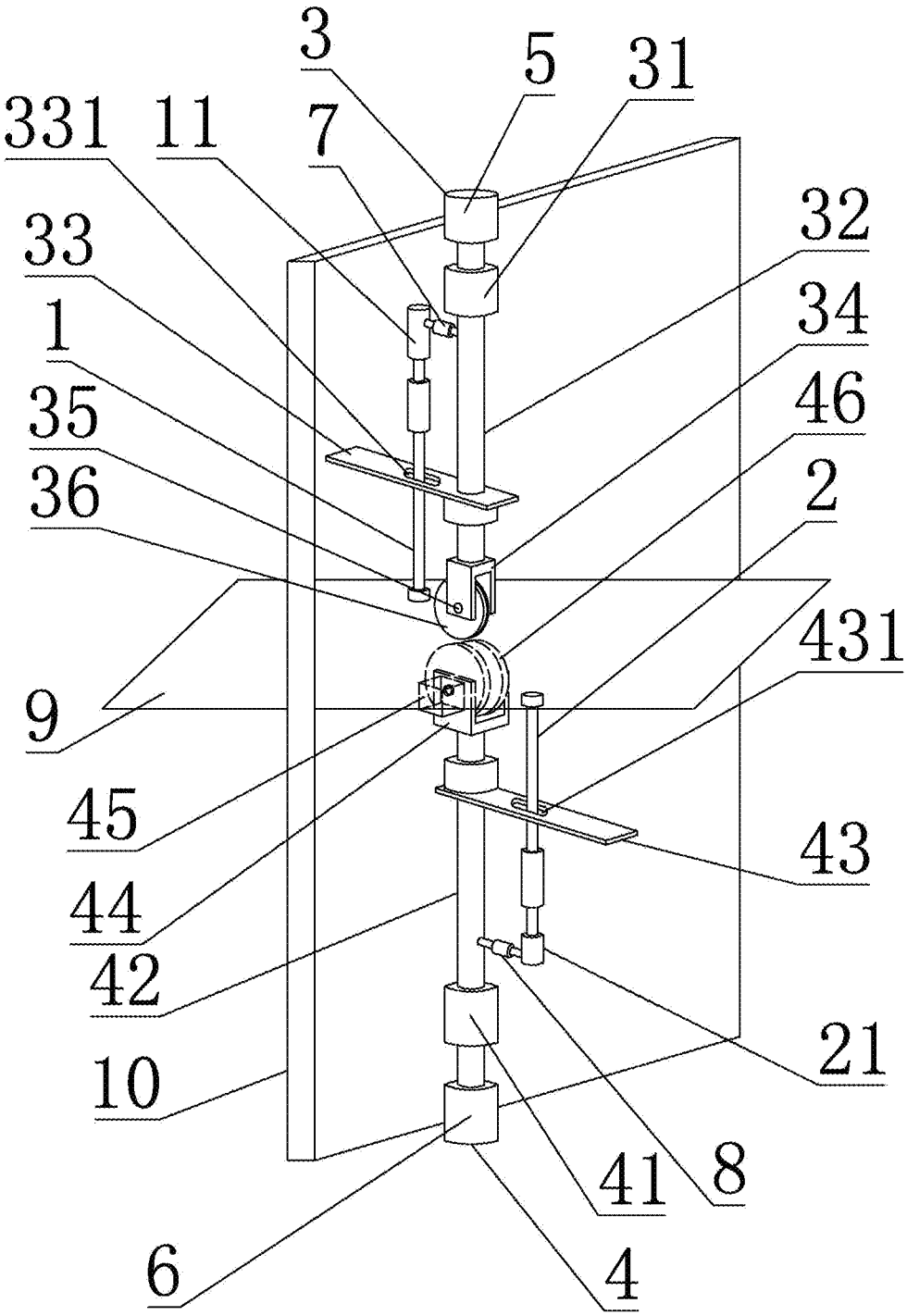

FIG. 1 is a flowchart illustrating an automatic integral forming method for a double-curvature plate of a ship of the invention; and FIG. 2 is a schematic view of a loading system for integral forming of the invention.

SPECIFIC EMBODIMENTS OF THE INVENTION

For clear understanding of the objectives, features and advantages of the invention, detailed description of the invention will be given below in conjunction with accompanying drawings and specific embodiments. It should be noted that the embodiments are only meant to explain the invention, and not to limit the scope of the invention.

FIG. 1 is a flowchart illustrating an automatic integral forming method for a double-curvature plate of a ship of the invention.

Firstly, a loading system for integral forming is constructed for a double-curvature plate of a ship to be formed. Referring to FIG. 2, the loading system for integral forming comprises a frame 10, and a heat loading component 1, a pressure loading device and a water spraying component 2 being sequentially disposed on the frame 10. The heat loading component 1 employs line heating. The pressure loading device comprises an upper pressure loading device 3 and a lower pressure loading device 4 collaborating with each other whereby applying pressure on the plate 9, the upper pressure loading device 3 comprises a first motor 31 removably disposed on the frame 10, an upper rotating shaft 32 is vertically disposed on the first motor 31 and capable of rotating under the drive thereof, an upper frame 33 and an upper base 34 are disposed on the upper rotating shaft 32, the upper frame 33 is disposed above the upper base 34, the heat loading component 1 is disposed on the upper frame 33, an upper roller 36 is rotatably disposed on the upper base 34 via an upper pin 35, the upper pin 35 is horizontally disposed, the lower pressure loading device 4 comprises a second motor removably disposed on the frame 10, a lower rotating shaft 42 is vertically disposed on the second motor 41 and capable of rotating under the drive thereof, a lower frame 43 and a lower receiving base 44 are disposed on the lower rotating shaft 42, the lower receiving base 44 is disposed above the lower frame 43, the water spraying component 2 is disposed on the lower frame 43, a third motor 45 is disposed on the lower receiving base 44, a lower roller 46 is disposed on the third motor 45 and capable of rotating under the drive thereof, and the lower roller 46 is disposed right under the upper roller 36.

A first power equipment 5 is disposed on the first motor 31 and capable of driving it to move upwards or downwards. Thus, the upper roller 36 can not only rotate under the drive of the first motor 31, but also move close to or away from the lower roller 46 under the drive of the first power equipment 5 whereby adjusting force applied to the plate 9.

A second power equipment 6 is disposed on the second motor 41 and capable of driving it to move upwards or downwards. Similarly, the lower roller 46 can also move close to or away from the upper roller 36 under the drive of the second power equipment 6 whereby adjusting force applied to the plate 9.

The heat loading component 1 is removably disposed on the upper frame 33, a third power equipment 7 is disposed on the upper rotating shaft 32, and capable of driving the heat loading component 1 to move close to or away from the upper roller 36. Furthermore, an upper sliding groove 331 operating as a movement channel of the heat loading component 1 is disposed on the upper frame 33, and the heat loading component 1 passes through the upper frame 33 at the upper sliding groove 331. A movement stroke of the heat loading component 1 is limited by the upper sliding groove 331.

The water spraying component 2 is removably disposed on the lower frame 43, and a fourth power equipment 8 capable of driving the water spraying component 2 to move close to or away from the lower roller 46 is disposed on the lower rotating shaft 42. Furthermore, a lower sliding groove 431 operating as a movement channel of the water spraying component 2 is disposed on the lower frame 43, the water spraying component 2 passes through the lower frame 43 at the lower sliding groove 431, and a movement stroke of the water spraying component 2 is limited by the lower sliding groove 431.

As for the loading system for integral forming constructed according to the present invention, the upper roller 36 and the lower roller 46 are oppositely disposed to each other, the first power equipment 5 drives the upper roller 36 to move downwards, the third power equipment 7 drives the lower roller 46 to move upwards, and force loading or displacement loading, and thus adjustment of curvature of the plate 9 are conducted by changing positions of the upper roller 36 and the lower roller 46 with respect to each other vertically.

In addition, the heat loading component 1 is capable of rotating along with the upper roller 36 with respect to the upper rotating shaft 32 under the drive of the upper rotating shaft 32, which makes it possible to adjust an angle of the upper roller 36, so that the pressure loading device applies pressure on the plate at different positions thereof whereby forcing the plate 9 to move in different directions and enabling the plate 9 to have a desired curvature.

The heat loading component 1 is also capable of moving along the upper sliding groove 331 so as to adjust a distance thereof from the upper roller 36. In this manner, if the plate 9 is heated to a desired temperature, it will be more convenient for the pressure loading device to apply force. The water spraying component 2 near the lower roller 46 is capable of rotating along with the lower roller 46 under the drive of the lower rotating shaft 42, and of moving along the lower sliding groove 431. In this manner, a plate 9 that is already formed but not completely cooled can be rapidly cooled down by spraying water thereon, and the plate 9 is deformed via a curved plate simultaneously operating in both cold and warm conditions. It should be noted that in terms of the upper roller 36 rotating under the drive of the upper rotating shaft 32, and the lower roller 46 rotating under the drive of the lower rotating shaft 42, stop positions of these two rollers after individual rotation should correspond to each other, so that they can collaborate with each other so as to form the plate 9.

Based on a fact that material properties of the plate 9 are associated with a temperature thereof, a heat affect zone generated by heat loading is used to restrict loading operation of the upper roller 36 and the lower roller 46 within the heat affect zone, so that the plate 9 is deformed in double curvatures, forming efficiency of the plate is increased, resilience caused by cold loading is reduced, and forming precision of the plate 9 is improved. After loading operation of the upper roller 36 and the lower roller 46, if the plate 9 is still at comparatively high temperature, water spraying operation is to be restricted within the heat affect zone via the water spraying component 2 for rapid cooling, so as to increase deformation of the plate 9 and thus forming efficiency thereof. Meanwhile, the water spraying component 2 is disposed under the plate 9, and there is a certain distance between the component and each of the heat loading component 1, the upper roller 36, and the lower roller 46, which ensure that temperature and pressure loading fully operate, and water is not to be remained in the plate 9 that is already deformed, and make it convenient to control cooling during water spraying.

The heat loading component 1, the pressure loading device, and the water spraying component 2 on the loading system for integral forming are not necessarily to be loaded simultaneously each time, and different combination thereof can be employed according to actual processing situations. For a process of driving the loading system to load the plate 9, the heat loading component 1, the pressure loading device, and the water spraying component 2 may conduct loading in multiple ways. Namely, the heat loading component 1, the pressure loading device and the water spraying component are simultaneously loaded on the plate 9, or only the pressure loading device is loaded, or both the heat loading component 1 and the pressure loading device are loaded, or the heat loading component 1 and the water spraying component 2 are loaded thereon.

Moreover, according to a preferred embodiment of the invention, the upper roller 36 and the lower roller 46 are of various shapes and sizes, and removably disposed on an upper side and a lower side of a transmission path of the plate 9, respectively. The upper roller 36 and the lower roller 46 maintain installation positions thereof constant, and drive the plate 9 to move by rotating with respect to each other, so as to ensure consistency with a feed direction of the plate 9.

As for the heat loading component 1, a shape thereof is cylindrical, and a bottom thereof is a line heating head operating to provide a temperature rising zone for the plate 9. As for the water spraying component 2, a shape thereof is cylindrical, and a cold water nozzle operating to conduct rapid cooling on a formed plate that is not cooled down, whereby allowing a larger temperature gradient. Advantageously, the heat loading component 1 is connected to the third power equipment 7 via a fifth power equipment 11 capable of driving the heat loading component 1 to move upwards and downwards, and the water spraying component 2 is connected to the fourth power equipment 8 via a sixth power equipment 21 capable of driving the water spraying component 2 to move upwards and downwards, which make it more convenient to heat and cool the plate 9. The heat loading component 1, the upper roller 36, the lower roller 46, and the water spraying component 2 act on a same move direction of the plate 9.

Therefore, it is expected to combine advantages of line heating of the heat loading component 1, rolling of the upper roller 36 and the lower roller 46, and water spray cooling of the water spraying component 2, and to integrally apply them to forming of the double-curvature plate, whereby overcoming a defect with a conventional line heating method that a large-curvature plate cannot be processed, and effectively preventing unwanted impact of high temperature on the material properties of the plate 9. Moreover, it is possible to improve processing efficiency, to efficiently prevent unwanted impact of high temperature or rapid cooling on the material properties of the plate 9, to reduce operation complexity of the process, and to further improve forming precision by combining different loading methods according to actual requirement.

Moreover, inputs of the plate that is to be formed comprise basic data such as material properties, a thickness, a target shape, and a target curvature thereof. Then a relationship between the basic data of the plate 9 and processing data thereof is established by ways of computer simulation, spatial curved surface geometry analysis, experiments, actual processing experience and so on according to requirement for a forming process. In details, the processing data comprise shapes of an upper roller 36 and a lower roller 46, force applied thereby or displacement thereof, enabling/disabling of the heat loading component heating the plate 9 by line heating and a position thereof, input voltage and current for heat control, enabling/disabling of the water spraying component 2, water flow and a position thereof, and starting and ending positions, travel trajectories and travel speeds operating to maintain status of integral forming.

According to another preferred embodiment of the invention, a process of establishing a relationship between the basic data of the plate and one of integral forming loading parameters and loading paths thereof preferably comprises establishing an expert database for integral forming. The expert database operates to quickly obtain processing data corresponding to basic data that are input, or to obtain following processing data as plastic deformation occurs and there is difference between forming effect and the processing target of the plate 9. Thus, compared with conventional forming methods relying on manual operation and personal experience, the present invention is capable of significantly increasing automation and forming efficiency during construction of a ship and shortening a manufacturing period, which is of great significance to the ship-building industry, and can bring about remarkable economic benefits.

Moreover, according to a further preferred embodiment of the invention, a proper algorithm, such as an artificial neural network algorithm and so on can be employed to obtain the optimum processing data, which can effectively reduce a length of a loading path, and further improve forming precision and efficiency. Specific operation of the algorithm is: firstly the basic data of the plate 9 are selected as input samples of the neutral network, and the integral forming loading parameters and the loading paths are selected as output samples, the neutral network is trained using the input samples and the output samples whereby optimizing the number of neurons and that of hidden layers thereof, and finally an optimized network is stored in the expert database for the purpose of reservation.

In addition, prototyping software drives the loading system to load the plate 9 using proper processing data according to the relationship established above. During this process, firstly the heat loading component 1 is driven to heat the plate 9 to a specified temperature, then the upper roller 36 and the lower roller 46 are driven to conduct force loading or displacement loading at the specified temperature so that the plate 9 is bent, and at the time, enabling/disabling of the water spraying component 2, and water flow and a position thereof can be determined as required, as explained above with respect to the loading system for integral forming. In this manner, the plate 9 is plastically deformed in double curvatures via loading of surface thereof by the heat loading component 1, the pressure loading device, and the water spraying component 2.

According to a still further embodiment of the invention, a process of driving the loading system to load the plate 9 in the above-mentioned step preferably employs partial loading and incremental forming. The partial loading enables curvature of the plate 9 to slowly approach and finally reach the target curvature, which makes it possible to resist deformation resilience, and to reduce driving force that the loading system for integral forming requires, and requirement for the loading system and an installation foundation thereof.

Furthermore, three factors need to be taken into consideration so as to obtain a relationship between the basic data and the processing data: the first one is a relationship between deformation of the plate 9 varying from a plane thereof to a target curved surface and strain distribution or spatial curvature (namely determining curvature of the plate 9), the second one is obtaining a parameter combination of a loading system with the strain distribution or the spatial curvature (namely a combination of different parameters of the processing data), and the third one is specific operation of a loading system having the strain distribution and the spatial curvature capable of facilitating shapes of the plate with the target curvature (namely the heat loading component 1, the pressure loading device, and the water spraying component 2 collaborate with each other whereby conducting loading on the plate 9). In calculation, distributed calculation for heat transfer is conduced to form the database, then elastoplastic calculation of force loading is conducted, followed by thermal elastoplastic calculation that simulates rapid cooling by water, with statistical repetition being performed for every single calculation. In this way, test results indicate that simulation efficiency can be further improved.

Finally, forming effect of the plate 9 is monitored, and difference between a formed shape and curvature and a target shape and curvature are detected and fed back. Based on the difference, and the above-mentioned steps of determination, loading and monitoring are repeated until a double-curvature plate meeting requirement for a processing target is formed. Preferably, in this step, a laser monitoring technique is employed to monitor the forming effect of the plate in real time, and to detect and to feed back difference between the formed effect and the processing target. In this manner, by monitoring and detecting the formed shape and the target shape, and feeding back difference therebetween, it is possible to render the expert database for planning loading parameters and loading paths for integral forming, and for loading and processing via automatic traveling until the formed shape of the plate reaches the target shape.

To summarize, the integral forming method of the invention effectively combines advantages of both cold forming and line heating, and integrally applies them to the forming process via specific-use devices and a computer simulation technology. The invention is especially applicable for automatic forming of large-curvature plates such as saddle-shaped plates, sail-shaped plates, twisted plates, plates combining shapes thereof and so on due to a fact that it can improve processing efficiency and reduce unwanted impact of processing on the material properties of the plate 9, and features high intelligence, high precision, and wide application range.

While preferred embodiments of the invention have been described above, the invention is not limited to disclosure in the embodiments and the accompanying drawings. Any changes or modifications without departing from the spirit of the invention fall within the scope of the invention.

What is claimed is:

1. An automatic integral forming method for a double curvature plate of a ship, comprising:

a) providing a loading system for integral forming, wherein said loading system for integral forming comprises:

a frame and a control device disposed on said frame, a heat loading component, a pressure loading device, and a water spraying component sequentially disposed on said frame, wherein said heat loading component heats a plate to be formed by line heating, and said pressure loading device comprises an upper pressure loading device including an upper roller and a lower pressure loading device including a lower roller, said upper pressure device and said lower pressure loading device collaborating with each other, thereby applying pressure on said plate;

b) correlating basic forming data and processing data of said plate according to a construction requirement for a forming process, wherein said basic forming data comprises material properties, a thickness, a target shape, and a target curvature of said plate, and said processing data comprises shapes of said upper roller and said lower roller, force applied thereby or displacement thereof, thereby enabling/disabling of said heat loading component heating said plate by line heating and a position thereof, input voltage and current for heat control, enabling/disabling of said water spraying component, water flow and a position thereof, and starting and ending positions, travel trajectories, and travel speeds of said heat loading component, said pressure loading device, and said water spraying component that maintain loading status;

c) inputting basic forming data into said control device obtaining processing data according to said basic forming data based on said correlating of said basic forming data and said processing data, driving said heat loading component, said pressure loading device, and said water spraying component to load said plate so that said plate is plastically deformed in double curvatures;

d) monitoring a deformation effect of said plate that is plastically deformed, detecting if there is difference between a shape and curvature thereof and said target shape and curvature, thereby enabling said loading system to load said plate until a double-curvature plate meeting requirement for a processing target is formed if there is difference therebetween.

2. The automatic integral forming method for a double-curvature plate of a ship of claim 1, wherein said upper pressure loading device comprises a first motor disposed on said frame, an upper rotating shaft is vertically disposed on said first motor and capable of rotating under the drive thereof, said upper roller is disposed on said upper rotating shaft said lower pressure loading device comprises a second motor disposed on said frame, a lower rotating shaft is vertically disposed on said second motor and capable of rotating under the drive thereof, a lower frame and a lower receiving base are disposed on said lower rotating shaft, said lower receiving base is disposed above said lower frame, said water spraying component is disposed on said lower frame, a third motor is disposed on said lower receiving base, and said lower roller is disposed on said third motor and capable of rotating under the drive thereof.

3. The automatic integral forming method for a double-curvature plate of a ship of claim 2, wherein in step a), said upper roller and said lower roller are of various shapes and sizes and are removably disposed on said upper rotating shaft and said lower rotating shaft, respectively.

4. The automatic integral forming method for a double-curvature plate of a ship of claim 1, wherein correlating said basic forming data and said processing data of said plate of step (b comprises firstly inputting said material properties, said thickness, and all processing data from said basic forming data, and then performing thermal elastic plastic simulation or spatial curved surface geometry analysis, thereby obtaining said target shape and said target curvature in said basic forming data.

5. The automatic integral forming method for a double-curvature plate of a ship of claim 4, wherein correlating said basic forming data and said processing data of said plate further comprises establishing an expert database for integral forming for said basic forming data and said processing data, and for obtaining processing data corresponding to basic forming data that are input, or to obtain following processing data from a difference between forming effect and said processing target of said plate.

6. The automatic integral forming method for a double-curvature plate of a ship of claim 5, wherein processing data in said expert database are optimized via an artificial neural network algorithm, comprising: simultaneously selecting said basic forming data of said plate as input samples and said processing data as output samples, training a neural network using said input samples and said output samples, thereby optimizing the number of neurons and that of hidden layers thereof, and storing an optimized network in said expert database for the purpose of reservation.

7. The automatic integral forming method for a double-curvature plate of a ship of claim 1, wherein in step c), during a process of driving said loading system to load said plate, said heat loading component, said pressure loading device, and said water spraying component conduct loading in multiple ways.

8. The automatic integral forming method for a double-curvature plate of a ship of claim 7, wherein conducting loading in multiple ways the loading on said plate of said heat loading component, said pressure loading device, and said water spraying component, or only said pressure loading device, or said heat loading component and said pressure loading device, or said heat loading component and said water spraying component.

9. The automatic integral forming method for a double-curvature plate of a ship of claim 1, wherein in step d), monitoring of forming effect of said plate, and detecting if there is a difference between said forming effect and said processing target are conducted via a laser monitoring technique.

* * * * *